US009468805B2

(12) United States Patent
White

(10) Patent No.: US 9,468,805 B2
(45) Date of Patent: Oct. 18, 2016

(54) FINGER STRENGTHENING DEVICE FOR CLIMBERS AND FINGER STRENGTH ENTHUSIASTS

(76) Inventor: Michael Robert White, Berkeley, CA (US)

( * ) Notice: Subject to any disclaimer, the term of this patent is extended or adjusted under 35 U.S.C. 154(b) by 397 days.

(21) Appl. No.: 13/482,342

(22) Filed: May 29, 2012

(65) Prior Publication Data

US 2012/0329610 A1 Dec. 27, 2012

Related U.S. Application Data

(60) Provisional application No. 61/491,290, filed on May 30, 2011.

(51) Int. Cl.
*A63B 21/00* (2006.01)
*A63B 23/16* (2006.01)

(52) U.S. Cl.
CPC ..... *A63B 23/16* (2013.01); *A63B 21/4035* (2015.10)

(58) Field of Classification Search
CPC ..... A63B 21/00
USPC ..... 482/49, 48, 81, 82
See application file for complete search history.

(56) References Cited

U.S. PATENT DOCUMENTS

| | | | | |
|---|---|---|---|---|
| 2,848,234 | A * | 8/1958 | Thomas | A63B 69/3647 473/204 |
| 4,647,037 | A * | 3/1987 | Donohue | A63B 5/20 482/108 |
| 5,403,008 | A * | 4/1995 | Mainiero | A63B 23/16 473/201 |
| 6,022,299 | A | 2/2000 | Stewart | |
| D484,929 | S | 1/2004 | Mollet | |
| D558,283 | S | 12/2007 | Mollet | |
| 8,113,993 | B2 * | 2/2012 | McVan | 482/49 |

* cited by examiner

*Primary Examiner* — Jerome W Donnelly
(74) *Attorney, Agent, or Firm* — Quine Intellectual Property Law Group P.C.; Gary Baker

(57) ABSTRACT

Disclosed herein is a device for finger and grip strength exercise. The finger strengthening device comprises a molded shape with ledges and cavity's suitable for gripping by a human hand with a connector ring or u-bolt mounted therein whereby connector ring can be attached to resistance training device.

8 Claims, 7 Drawing Sheets

FINGER STRENGTHENING DEVICE FOR CLIMBERS AND FINGER STRENGTH ENTHUSIASTS

CROSS-REFERENCE TO RELATED APPLICATIONS

This application claims the benefit of provisional patent Ser. No. 61/491,290, filed 2011 May 30 by the present inventor.

BACKGROUND

This application relates to grip and finger strength, particularly to methods to build finger and grip strength

PRIOR ART

The following is a tabulation of some prior art that presently appears relevant:

US Patents

| Pat. No. | Kind Code | Issue Date | Patentee |
|---|---|---|---|
| D558,283 S | B1 | 2007-12-25 | Mollet |
| D484,929 S | B1 | 2006-01-06 | Mollet |
| 6,022,299 | B1 | 200-02-08 | Stewart |

Finger strength is an important part of many sports including but not limited to climbing, weightlifting and self defense. Many enthusiasts of these and other sports train on exercise machines in gyms or at home. They also use many forms of training that utilize resistance, whether it be the weight of their own body or the weight of metal plates on a cable pulley exercise machine or a rubber strap, band or tube. Many climbers utilize hangboards that are placed over a doorway in their home, exercise gym or artificial climbing facility. Many artificial climbing facility's provide climbers with training methods to promote and develop finger strength.

Although hangboards are useful for climbers to build finger strength they are limited. This is due to fact that they are designed to hang from. When hanging from a hangboard using finger strength, only slow twitch muscles are engaged. When someone is actively climbing, both fast twitch and slow twitch muscle groups are required to hold on and pull oneself upwards.

Cable pulley machines are useful in developing arm strength. While training on a cable machine the user can develop and strengthen fast twitch muscles. This however does not train finger strength, as the handle is usually a round steel bar that the whole hand can easily wrap around.

SUMMARY

In accordance with one embodiment, the finger strengthening device is comprised of but not limited to a molded shape that has various edges, ledges and cavities with a ring or u bolt connector embedded that can be attached to a resistance training device.

BRIEF DESCRIPTION OF THE DRAWINGS

FIG. 1A shows a side view of this embodiment of the device with pinch and ledge features. FIG. 1B shows a back view of this embodiment of the finger exercising device. FIG. 1C shows a front view of this embodiment of the device. FIG. 1D shows a perspective view of this embodiment of the device with the connector ring component shown outside the main body.

FIG. 2A shows a side view of the wide grip device. FIG. 2B shows a front view of the wide grip device. FIG. 2C shows a perspective view of the wide grip finger exercising device with the connector u-bolt component shown outside the main body. FIG. 2D shows a perspective view of the wide grip device with the connector u-bolt component mounted.

FIG. 3A shows a side view of the spherical device. FIG. 3B shows a front view of the spherical device. FIG. 3C shows a perspective view of the spherical device with the connector u-bolt component shown outside the main body. FIG. 3D shows a perspective view of the spherical device with the connector u-bolt component mounted.

Advantages

The finger strengthening device can be attached to a variety of resistance training devices. In some cases this allows the user to set a chosen amount of weight while training finger strength or pinch strength. This minimizes the risk of injury associated with hangboards or resistance training that utilizes body weight. It also provides a methodical way to incrementally develop finger strength, by conditioning the small tendons and pulleys in the fingers.

DRAWINGS

FIGS. 1A, 1B, 1C 1D—First Embodiment

Figure 1A:
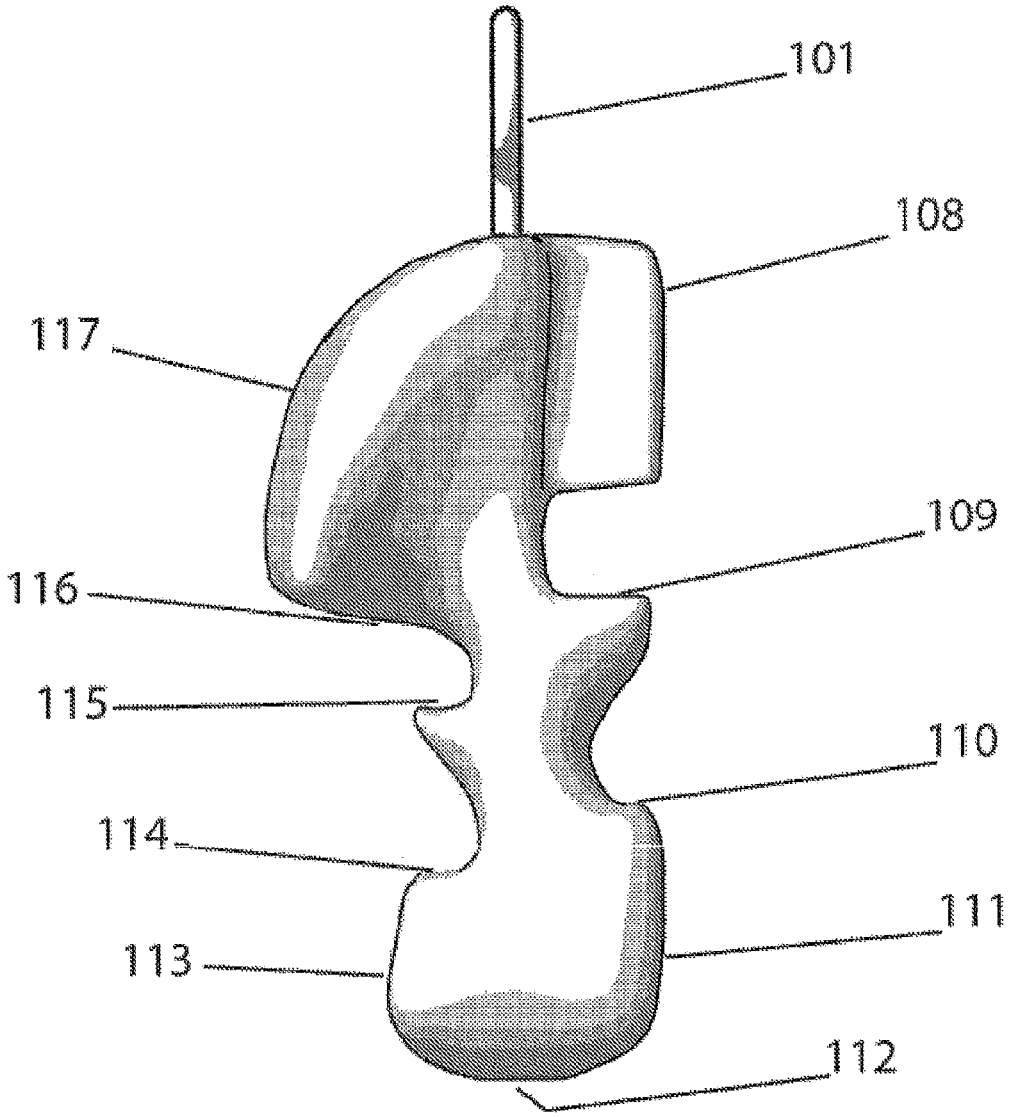
FIGS. 1A to 1D show a finger exercising device from four different perspectives.

FIG. 1A shows a side view of this embodiment of the device.

Figure 1B:
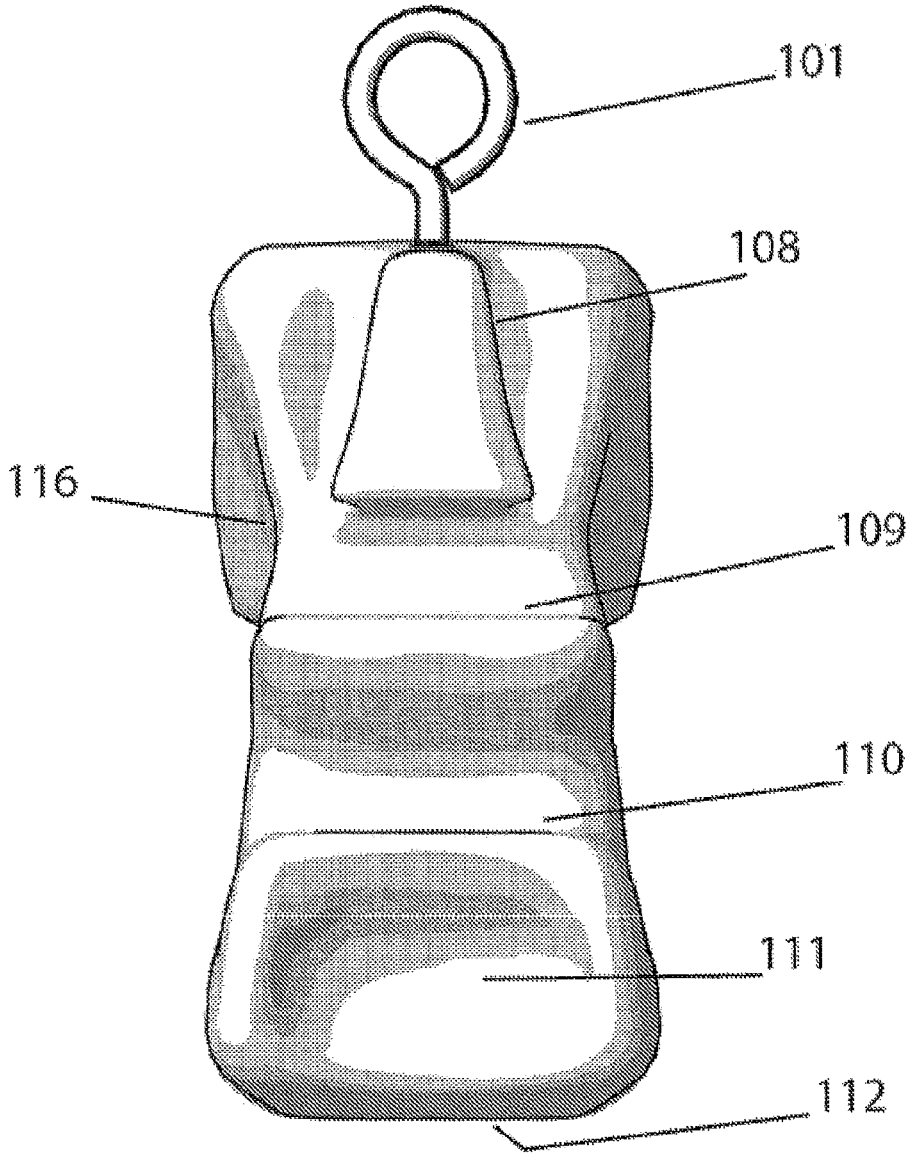

FIG. 1B shows a back view of this embodiment of the device.

Figure 1C:
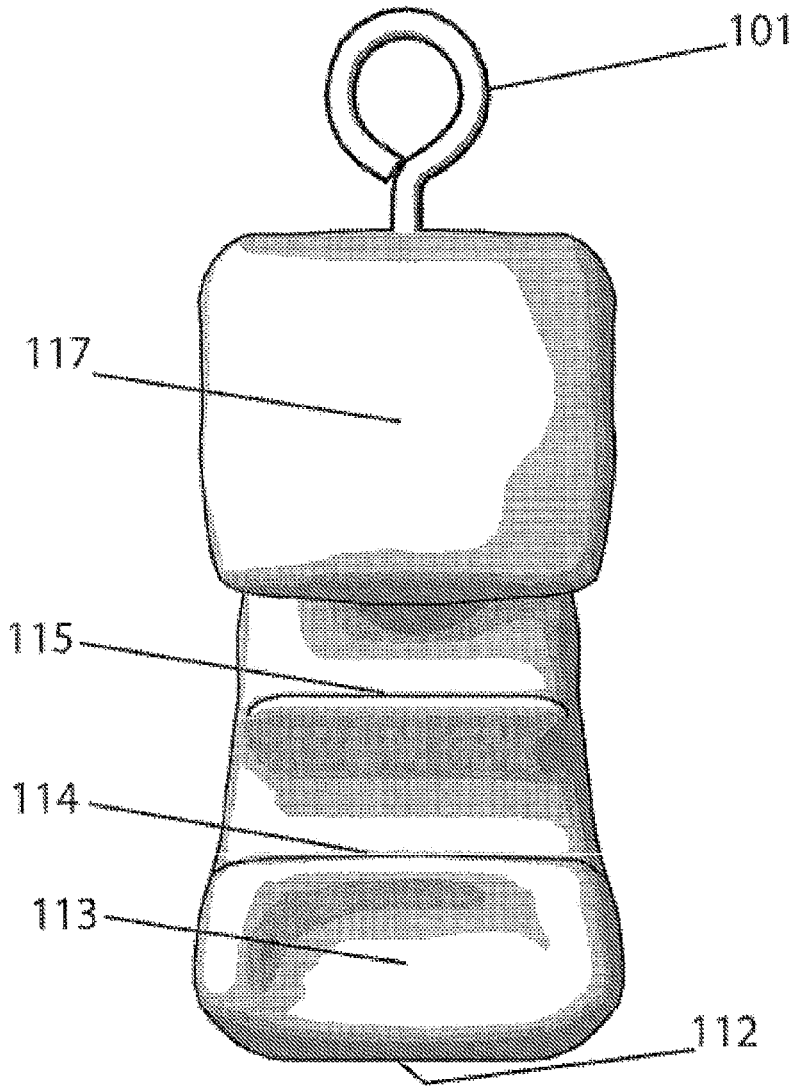

FIG. 1C shows a front view of this embodiment of the device.

Figure 1D:
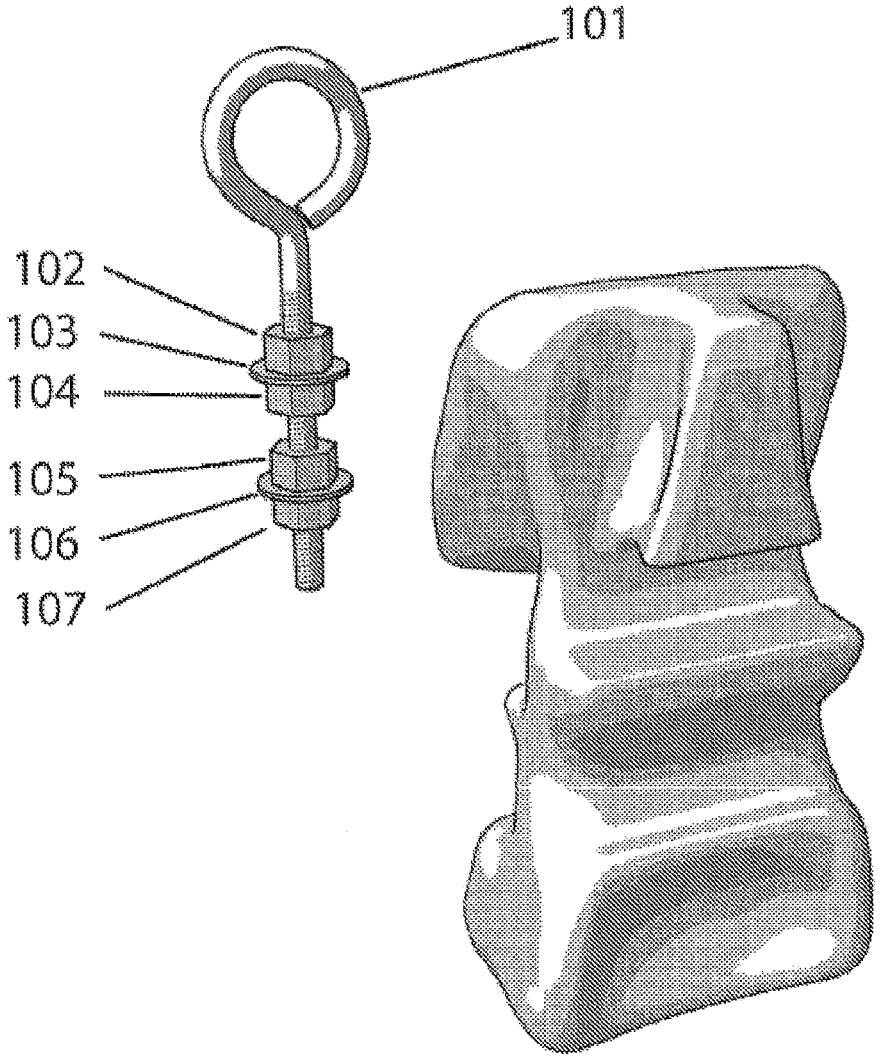

FIG. 1D shows a perspective view of this embodiment of the device with the connector ring component shown outside the main body.

REFERENCE NUMERALS

FIGS. 1A, 1B, 1C and 1D—First Embodiment

| | |
|---|---|
| 101 | Connector ring ⅜ × 5" Eye Bolt |
| 102 | ⅜ Nut mounted on 5" Eye bolt |
| 103 | ⅜ Washer mounted on 5" Eye bolt |
| 104 | ⅜ Nut mounted on 5" Eye bolt |
| 105 | ⅜ Nut mounted on 5" Eye bolt |
| 106 | ⅜ Washer mounted on 5" Eye bolt |
| 107 | ⅜ Nut mounted on 5" Eye bolt |
| 108 | Vertical pinch grip |
| 109 | Large finger ledge |
| 110 | Small finger ledge |

-continued

| | |
|---|---|
| 111 | Cavity for medium width pinch |
| 112 | Wide pinch |
| 113 | Cavity for medium width pinch |
| 114 | Medium sloped finger ledge |
| 115 | Medium flat finger ledge |
| 116 | Thumb catch for sloper |
| 117 | Sloper area |

DETAILED DESCRIPTION

FIGS. 1A, 1B, 1C and 1D—First Embodiment

The finger strengthening device is made up of two main components: the main body and the connector ring. The connector ring component is comprised of a ring with nuts and washers. The main body is shaped so that it is suitable to be gripped by a human hand for the purpose of training grip and finger strength.

One embodiment of the finger strengthening device is illustrated in FIGS. 1A, 1B, 1C and 1D. This embodiment includes a 101 connector ring, 102,104,105,107 four ⅜ nuts, 103,106 two ⅜ washers, a 108 vertical pinch area, 109,110, 114,115 four finger ledges of varied size, a 111,113 medium sized horizontal pinch area, a 112 wide horizontal pinch area and a 117 sloped area with a 116 thumb catch.

Operation

FIGS. 1A, 1B, 1C, 1D

The 101 connector ring can be attached to a resistance device and hung vertically. While in the vertical position the 108 vertical pinch area and the 109,110,114,115 four finger ledges and the 117 sloped area with 116 thumb catch can be utilized while the device is pulled downwards on any type of resistance.

The 101 connector ring can be attached to a horizontal resistance device. While on a horizontal resistance device the 111,113 medium sized pinch and the 112 wide sized pinch can be utilized while pulling in a horizontal direction.

Fabrication

The finger strengthening device can be made through the technique of casting and molding. The main body shape is carved and then a mold is made from the carving.

The connector ring is embedded in the mold. The martial to be used is then poured into the mold cavity as a liquid where it surrounds the nuts and washers on the connector ring or u-bolt prior to hardening. The connector component cannot be pulled out of the main body once the material hardens.

Additional Embodiments

2A, 2B, 2C, 2D—Additional Embodiments

Figure 2A:
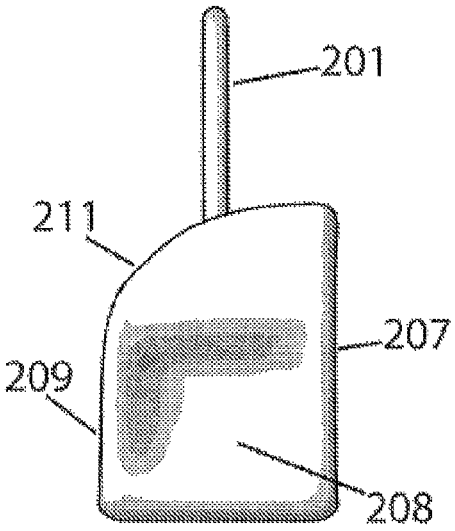
FIGS. 2A to 2D show a wide grip finger exercising device comprising features such as a u-bolt and sloper grip.

FIG. 2A shows a side view of an additional embodiment.

Figure 2B:
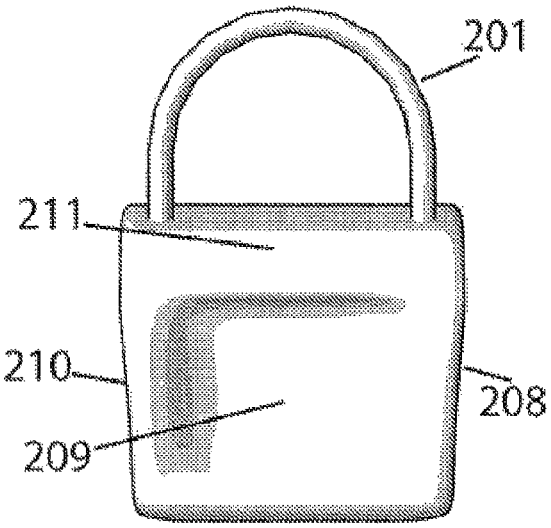

FIG. 2B shows a front view of an additional embodiment.

Figure 2C:
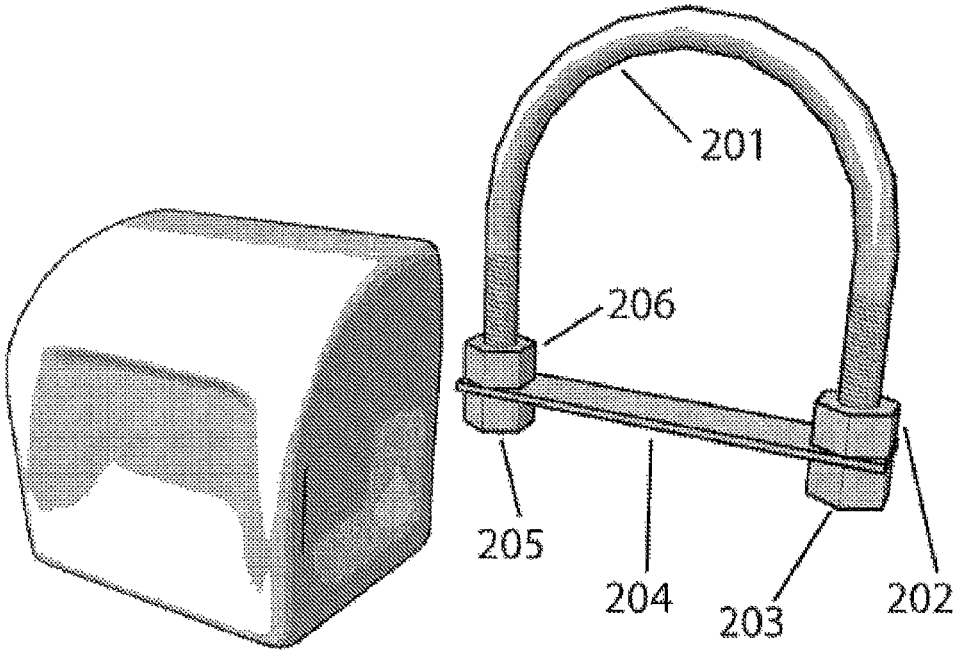

FIG. 2C shows a perspective view of an additional embodiment with the connector u-bolt component shown outside the main body.

Figure 2D:
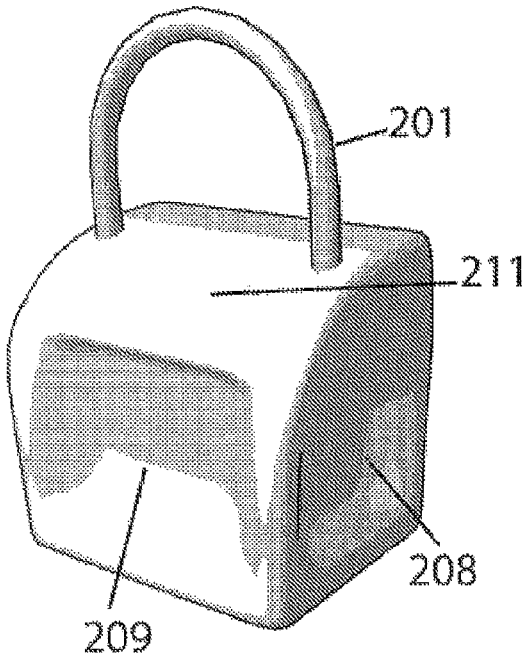

FIG. 2D shows a perspective view of an additional embodiment with the connector u-bolt component mounted.

Reference Numerals

FIGS. 2A, 2B, 2C, 2D—Additional Embodiments

| | |
|---|---|
| 201 | Connector U-bolt |
| 202 | ⅜ Nut mounted on U-bolt |
| 203 | ⅜ Nut mounted on U-bolt |
| 204 | Plate mounted on U-bolt |
| 205 | ⅜ Nut mounted on U-bolt |
| 206 | ⅜ Nut mounted on U-bolt |
| 207 | Medium pinch grip |
| 208 | Wide pinch grip |
| 209 | Medium pinch grip |
| 210 | Wide pinch grip |
| 211 | Sloper grip area |

Detailed Description

FIGS. 2A, 2B, 2C and 2D—Additional Embodiment

This embodiment of the finger strengthening device is made up of two main components: the main body and the connector u bolt. The connector u bolt component is comprised of a u bolt with nuts and a plate. The main body is shaped so that it is suitable to be gripped by a human hand. This embodiment is rectangular on one axis and has a curved surface leading up to the connector u-bolt as seen in FIG. 2A.

Operation

FIGS. 2A, 2B, 2C and 2D—Additional Embodiment

The 201 connector u-bolt can be attached to a resistance device and hung vertically or horizontally. While in the vertical position the 211 Sloper grip area can be held while the device is pulled downwards on any type of resistance. The 207,209 medium pinch grip areas and 208,210 wide pinch grip areas can be used with fingers and thumb inserted on each side to create a wide grip for the hand and pulled on vertically or horizontally

3A, 3B, 3C and 3D—Additional Embodiments

Figure 3D:
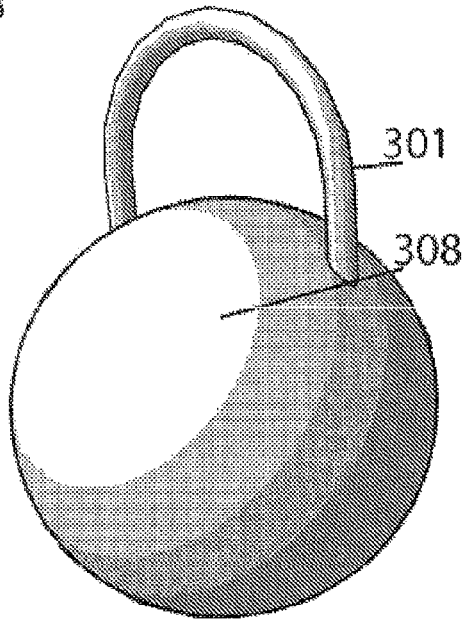
FIGS. 3A to 3D show perspectives of a spherical grip finger exercising device.
Figure 3A:
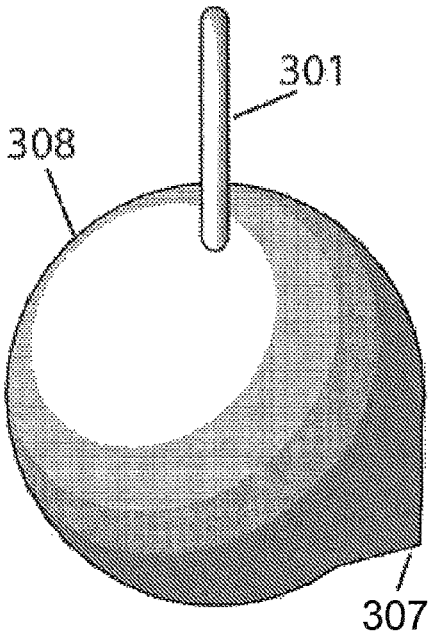

FIG. 3A shows a side view of an additional embodiment.

Figure 3B:
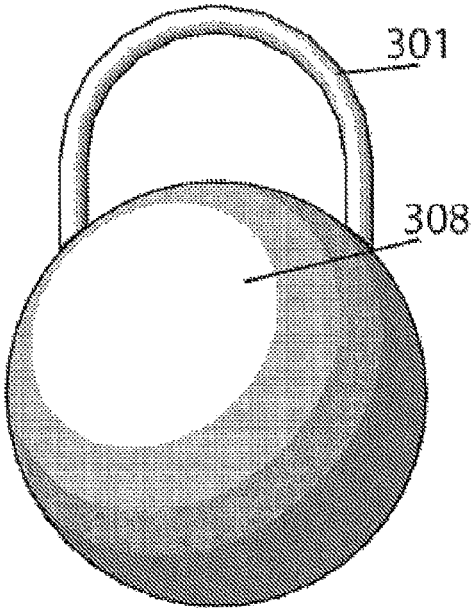

FIG. 3B shows a front view of an additional embodiment.

Figure 3C:
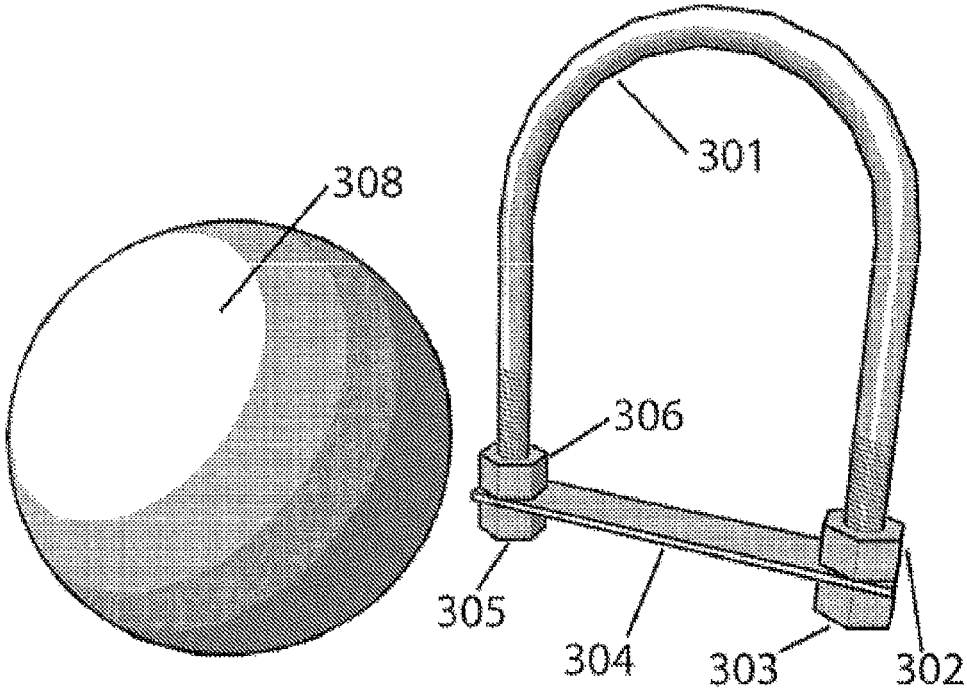

FIG. 3C shows a perspective view of an additional embodiment with the connector u-bolt component shown outside the main body.

FIG. 3D shows a perspective view of an additional embodiment with the connector u-bolt component mounted.

Reference Numerals

FIGS. 3A, 3B, 3C, 3D—Additional Embodiments

| | |
|---|---|
| 301 | Connector U-bolt |
| 302 | ⅜ Nut mounted on U-bolt |

-continued

| | |
|---|---|
| 303 | 3/8 Nut mounted on U-bolt |
| 304 | Plate mounted on U-bolt |
| 305 | 3/8 Nut mounted on U-bolt |
| 306 | 3/8 Nut mounted on U-bolt |
| 307 | Thumb catch/palm stabilizer |
| 308 | Sloper grip area |

Detailed Description

FIGS. 3A, 3B, 3C and 3D—Additional Embodiment

This embodiment of the finger strengthening device is made up of two main components: the main body and the connector u bolt. The connector u bolt component is comprised of a u bolt with nuts and a plate. This embodiment is spherical in shape and the u-bolt is centered in the sphere.

Operation

FIGS. 3A, 3B, 3C and 3D—Additional Embodiment

The 301 connector u-bolt can be attached to a resistance device and hung vertically or horizontally. While in the vertical position the 308 Sloper grip area can be held while the device is pulled downwards on any type of resistance while the 307 palm stabilizer is against the palm of the users hand. The sphere can also be held like a ball and pulled towards the users body.

Alternative Embodiments

There are many possibility's for alternative embodiments. Although the descriptions above contain many specificities, these should not be construed as limiting the scope of the embodiments but as merely providing illustrations of some of several embodiments. For example, the molded shape can be square, rectangular, spherical, triangular, ovular or any other shape that creates a grip able part that is beneficial for training grip strength. The connector point can be a ring, a loop, hook, a u shape or any shape that is suitable for connecting to a resistance device.

Thus the scope of the embodiments should be determined by the appended claims and their legal equivalents, rather than by the examples given.

I claim:

1. A finger exercise device comprising:

a connector shaft comprising a central axis, a top end, and a bottom end, and comprising a ring connected to the shaft top end;

a main grip body having a top end and a bottom end, and having the shaft mounted vertically within the main body at the top end;

a vertical pinch feature extending out from the main body with an upper end and a lower end and having a vertical length aligned parallel to the shaft central axis and the vertical pinch feature tapering out wider from the upper end to a lower end; and, a horizontal ledge feature comprising a substantially planar surface facing the top end in the main body and aligned perpendicular to the ring shaft central axis.

2. The device of claim 1, wherein the ring is a closed circle.

3. The device of claim 1, wherein the vertical pinch feature has a width less than the vertical length.

4. The device of claim 1, wherein the horizontal ledge planar surface extends out from the main body perpendicular to the shaft axis.

5. The device of claim 1, further comprising one or more additional horizontal ledge features having top planar surfaces extending out from the main body perpendicular to the shaft axis.

6. The device of claim 1, further comprising a sloped area comprising a rounded surface curving down from the main body top end.

7. The device of claim 1, further comprising a horizontal pinch area comprising indents on opposite sides of the main body.

8. The device of claim 1, connected to a resistance device at the ring.

* * * * *